US005399097A

United States Patent [19]

Sakai et al.

[11] Patent Number: 5,399,097

[45] Date of Patent: Mar. 21, 1995

[54] TERMINAL WITH CRAMP MEMBER

[75] Inventors: Hitoshi Sakai; Hiroshi Yamamoto, both of Shizuoka, Japan

[73] Assignee: Yazaki Corporation, Tokyo, Japan

[21] Appl. No.: 120,831

[22] Filed: Sep. 15, 1993

[30] Foreign Application Priority Data

Sep. 18, 1992 [JP] Japan ..... 4-273452

[51] Int. Cl.[6] ..... H01R 4/24

[52] U.S. Cl. ..... 439/395; 439/417

[58] Field of Search ..... 439/395, 407, 417, 418, 439/421, 422

[56] References Cited

U.S. PATENT DOCUMENTS 5,000,698 3/1991 Kuzuno et al. ..... 439/395
5,030,143 7/1991 Hatagishi ..... 439/395
5,112,244 5/1992 Kuzuno et al. ..... 439/395

FOREIGN PATENT DOCUMENTS 60-142463 9/1985 Japan .

*Primary Examiner*—David L. Pirlot
*Attorney, Agent, or Firm*—Sughrue, Mion, Zinn, Macpeak & Seas

[57] ABSTRACT

An object of the present invention is to provide a cramp terminal which assures that an electrical insulative cable can easily be press-fitted into U-shaped slots of cramping blades, and moreover, there does not arise a malfunction that the electrical insulative cable is disconnected from the slots. A terminal comprises a terminal body including: at least one cramping blade formed by bending a portion of the terminal body, the cramping blade having a slot formed therethrough so as to allow an electrical insulative cable to be press-fitted into the slot, the cramping blade being connected to side plates of the terminal body; a guide member formed on the side plates of the terminal body: a holding member defined in an upper edge portion of the side plate; and a cramping member for inserting the electrical insulative cable into the slot by thrusting the electrical insulative cable which is brought into contact with the cramping member in area.

5 Claims, 6 Drawing Sheets

TERMINAL WITH CRAMP MEMBER

BACKGROUND OF THE INVENTION

1. Field of the Invention

The present invention relates to a terminal for making electrical connection between an electrical insulative cable and the crimp terminal by crimping an electrical insulative cable usable for, e.g., a low voltage cable for an automobile (AV).

2. Related Art

A hitherto known crimp terminal is constructed such that when an electrical insulative cable is connected to a connector terminal, the cable is press-fitted into a slot formed on the crimp terminal, causing a part of the sheath provided around a cable conductor to be peeled away from the cable conductor, whereby the cable conductor is electrically connected to the crimp terminal. A typical conventional crimp terminal of the foregoing type is disclosed in Unexamined Japanese Utility Model Publication sho 60-142463.

In detail, as shown in FIG. 10 and FIG. 11, the conventional crimp terminal 1 is constructed such that a sheathed cable 11 is connected to the crimp terminal 1 formed by punching a sheet of electrical conductive metallic plate while the cramp terminal 1 is firmly fitted into a housing 10. In addition, an opponent post type terminal (not shown) is connected to a cylindrical electrical connecting portion 9 of the crimp terminal 1 by fitting the post type terminal into the electrical connecting portion 9.

The structure of the conventional crimp terminal 1 will be described in more detail below. A main body of the cramp terminal 1 is constructed of a base plate 2 of a sheet of electrical conductive metallic material and a pair of side plates 3 standing upright from the opposite sides of the base plate 2 by bending the latter. In addition, the crimp terminal 1 includes a pair of crimping blades 4 which are formed by upwardly bending the base plate 2 while a central part 2*a* of the latter is left unchanged. A U-shaped slot 5 is formed through each cramping blade 4 with the uppermost end of the latter kept opened in the upward direction so that an electrical insulative cable 11 is press-fitted into the slots 5, causing a sheath of the cable 11 to be peeled away from a cable conductor 13 of the electrical insulative cable 11, whereby the cable conductor 13 of the electrical insulative cable 11 comes in contact with the cramp terminal 1 via the crimping blades 4 to make electrical connection therebetween. To prevent the crimping blades 4 from being tilted in the longitudinal direction of the cable 11 during the press-fitting operation, tab pieces 6 extending outward of the opposite sides of the cramping blades 4 are engaged with cutout portions 7 formed through both the side plates 3 of the main body 2.

To assure that the cable 11 is reliably press-fitted into the slots 5, a press fitting jig 14 as shown in FIG. 12 is usually actuated by an operator. This press-fitting jig 14 includes a press-fitting portion 15 on which two cramping blade relief grooves 15*a* are formed. As the press-fitting jig 14 is lowered, the press-fitting portion 15 is inserted into the crimp terminal 1 so that the crimping blade relief grooves 15*a* are engaged with the cramping blades 4, whereby the cable 11 is uniformly squeezed against the cramping blades 4 at a right angle relative to the longitudinal direction of the cable 11, causing the cable conductor 13 of the electrical insulative cable 11 to be press-fitted into the slot 5.

However, if a certain positional deviation arises between the crimp terminal and the press-fitting jig for some reason before the press-fitting jig is brought in engagement with the crimp terminal, there arises a malfunction that the crimping blades 4 are undesirably damaged or broken by the press-fitting portion of the press-fitting jig due to the foregoing positional deviation of the press-fitting jig relative to the crimp terminal. With the conventional crimp terminal constructed in the above-described manner, it is certain that an electrical insulative cable can easily be connected to the cramp terminal. However, when a certain intensity of drawing power is applied to the cable in the P arrow-marked direction (see FIG. 11), there arises a malfunction that the cable is upwardly disconnected from the crimp terminal away from the slots.

SUMMARY OF THE INVENTION

In view of the forgoing problem, an object of the present invention is to provide a crimp terminal which assures that each cable fitting operation can reliably be performed not only without any damage or breakage of crimping blades due to positional deviation of a press-fitting jig relative to the crimp terminal but also without any disconnection of an electrical insulative cable from the crimp terminal.

To accomplish the above object, the present invention provides a terminal comprising: a terminal body including: at least one crimping blade formed by bending a portion of the terminal body, the crimping blade having a slot formed therethrough so as to allow an electrical insulative cable to be press-fitted into the slot, the crimping blade being connected to side plates of the terminal body; a guide member formed on the side plate of the terminal body; a holding member defined in an upper edge portion of the side plates; and a crimping member for inserting the electrical insulative cable into the slot by press-fitting the electrical insulative cable which is brought into contact with the crimping member in area.

Since the crimp terminal includes the crimping member adapted to come in contact with an electrical insulative cable in area, the latter can smoothly be press-fitted into the slots merely by thrusting the upper surface of the crimping member by actuating a press-fitting jig. In contrast with the conventional press-fitting jig having a complicated structure, the press-fitting jig may be designed in a simple pin-shaped configuration. With this pin-shaped press-fitting jig, a certain intensity of squeezing power can uniformly be imparted to an electrical insulative cable merely by squeezing the cramping member in the downward direction while the press-fitting jig is firmly seized.

Since the cramping member is fitted to the terminal casing while the slots of the cramping blades are closed with the cramping member, there does not arise a malfunction that the cable is upwardly disconnected from the slots of the cramping blades, and moreover, dust or similar foreign material invades into the connected part between the cable and the crimp terminal.

DETAILED DESCRIPTION OF THE PREFERRED EMBODIMENTS

The present invention will now be described in detail hereinafter with reference to the accompanying drawings which illustrate a few preferred embodiments thereof.

First, a crimp terminal constructed according to a first embodiment of the present invention will be described below with reference to FIG. 1 to FIG. 7.

Figure 1:
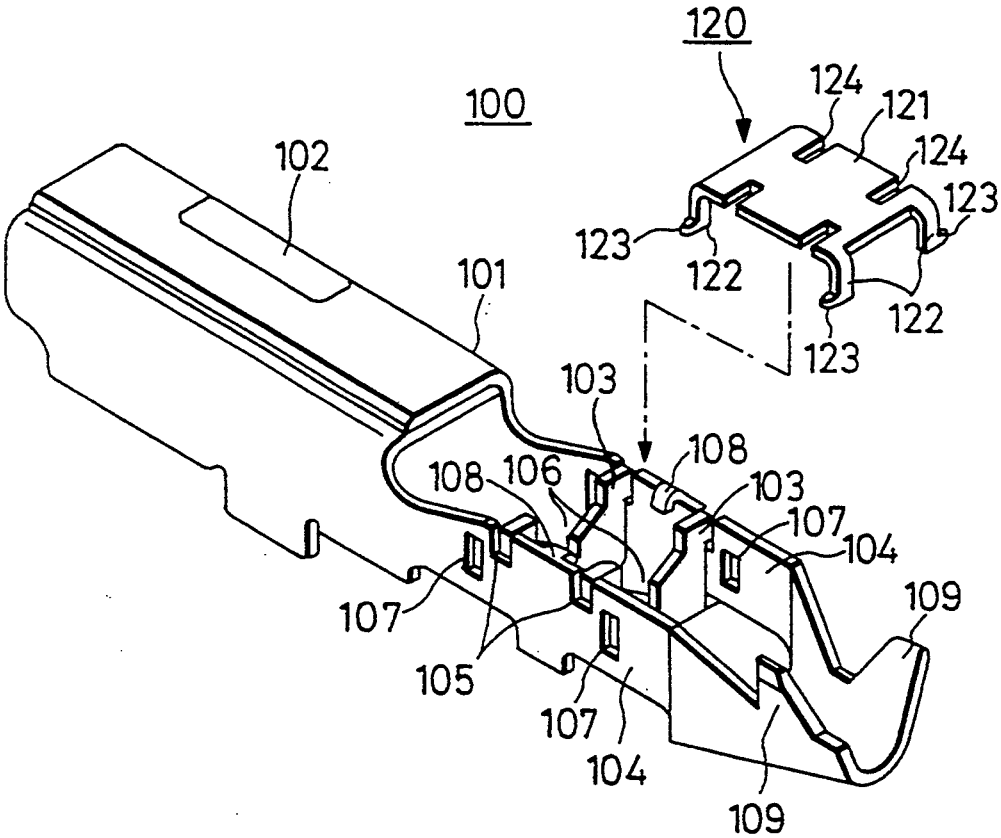
FIG. 1 is a perspective view of a crimp terminal constructed according to a first embodiment of the present invention, particularly showing essential components constituting the crimp terminal in the disassembled state.
Figure 2:
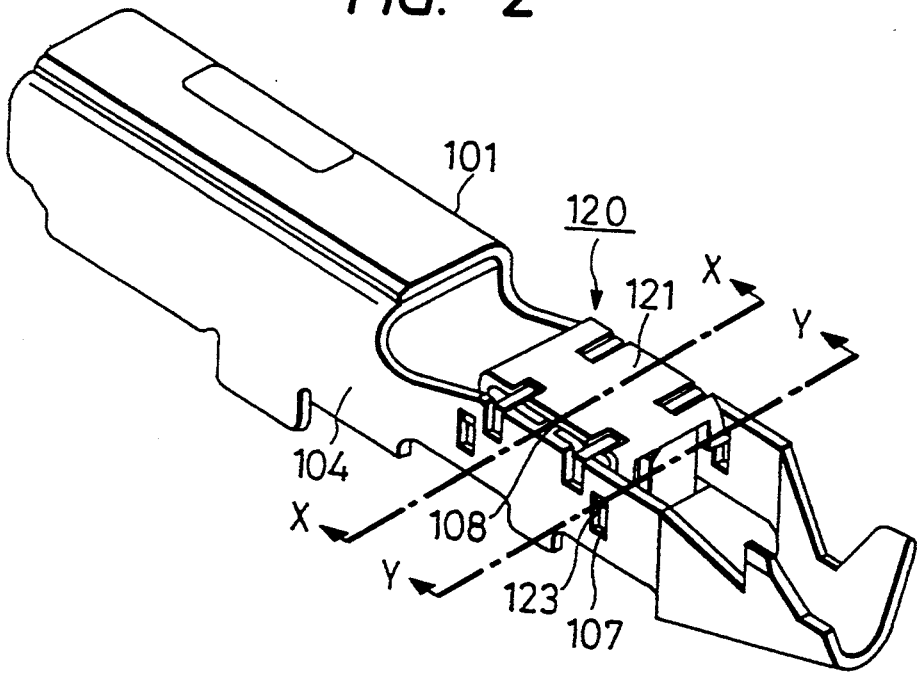
FIG. 2 is a perspective view of the crimp terminal shown in FIG. 1, particularly showing the initial state of the crimp terminal that a crimping member is fitted to a terminal casing.
Figure 3:
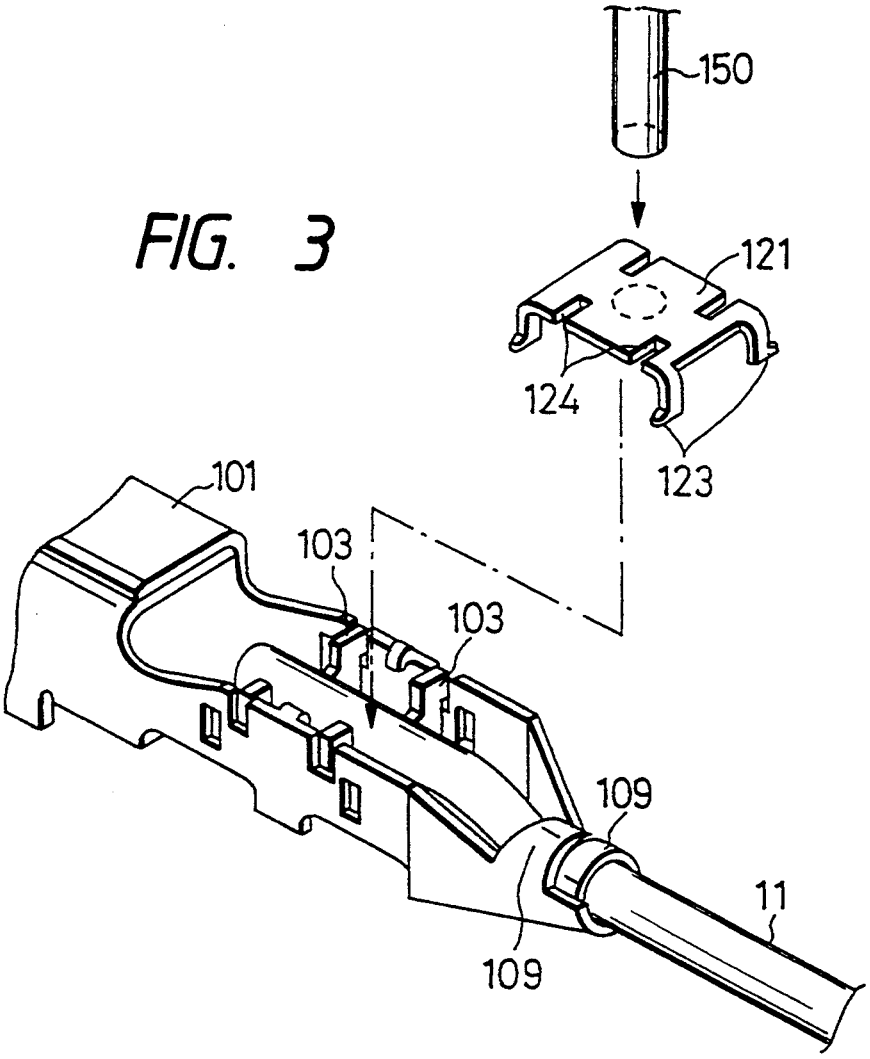
FIG. 3 is a fragmentary perspective view of the crimp terminal constructed according to the first embodiment of the present invention, particularly showing a series of steps for connecting an electrical insulative cable to the crimp terminal.
Figure 4:
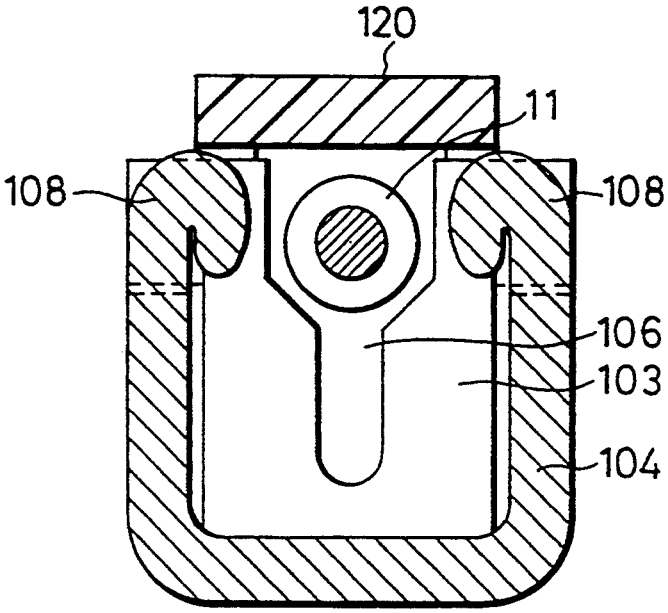
FIG. 4 is an enlarged cross-sectional view of the crimp terminal taken along line X—X in FIG. 2, particularly showing a step before the electrical insulative cable is connected to the crimp terminal in the crimped state.
Figure 5:
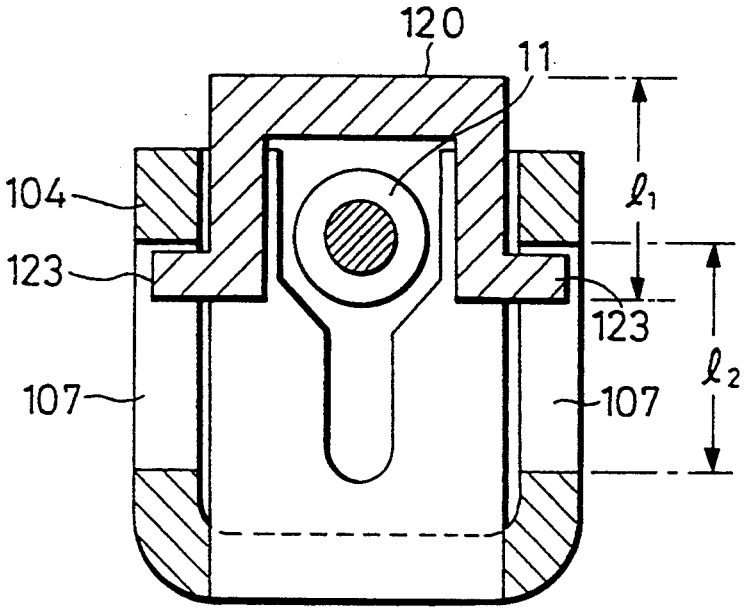
FIG. 5 is an enlarged cross-sectional view of the crimp terminal taken along line Y—Y in FIG. 2, particularly showing another step before the electrical insulative cable is connected to the crimp terminal in the crimped state.
Figure 6:
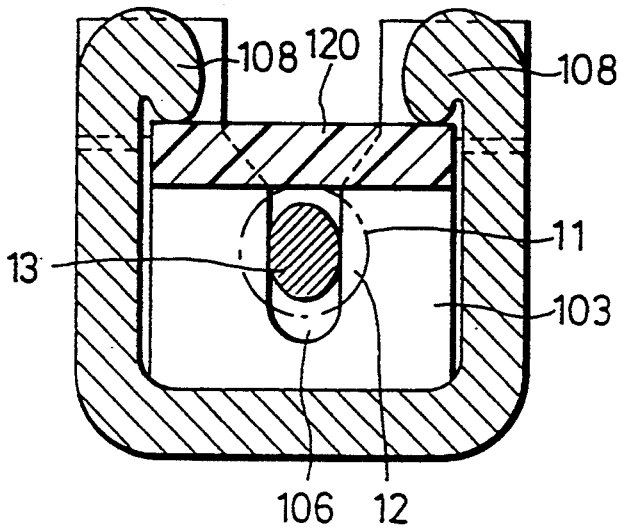
FIG. 6 is an enlarged cross-sectional view of the crimp terminal taken along line X—X in FIG. 2, particularly showing a step after the electrical insulative cable is connected to the crimp terminal in the crimped state.
Figure 7:
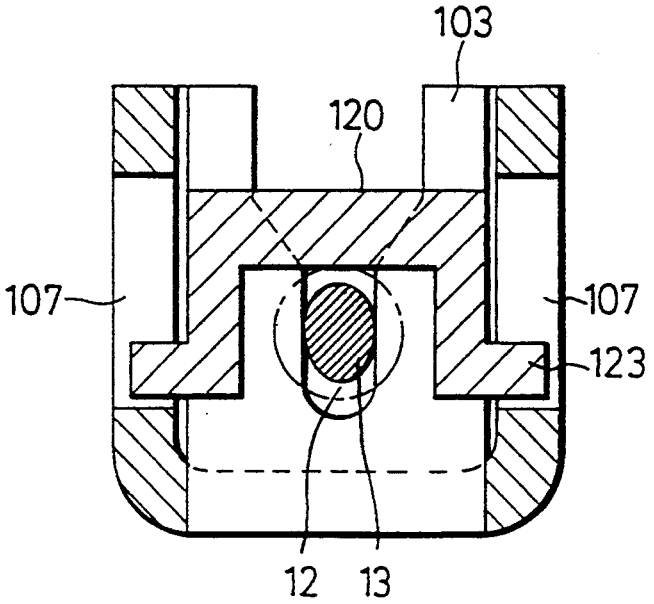
FIG. 7 is an enlarged cross-sectional view of the crimp terminal taken along line Y—Y in FIG. 2, particularly showing another step after the electrical insulative cable is connected to the crimp terminal in the crimped state.

FIG. 1 is a perspective view of the crimp terminal constructed according to the first embodiment of the present invention, particularly showing the structure of the crimp terminal in the disassembled state, FIG. 2 is a perspective view of the crimp terminal shown in FIG. 1, particularly showing the initial operative state that a crimping member is fitted to a terminal casing, and FIG. 3 to FIG. 7 show a series of steps for connecting an electrical insulative cable to the crimp terminal. Among these drawings, FIG. 4 and FIG. 6 are cross-sectional views each taken along line X—X in FIG. 2, and FIG. 5 and FIG. 7 are cross-sectional views each taken along line Y—Y in FIG. 2.

Figure 10:
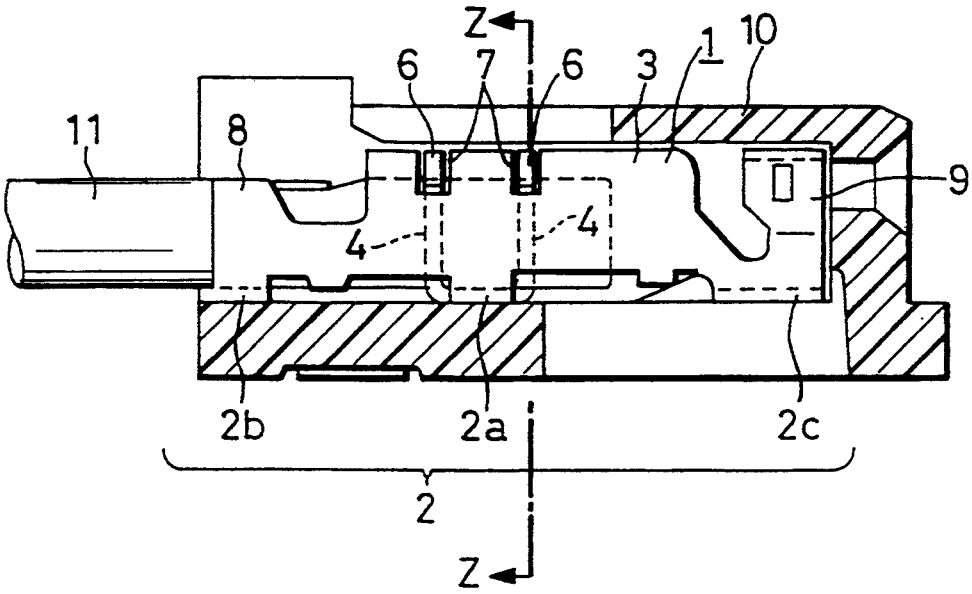
FIG. 10 is a vertical sectional view of a conventional crimp terminal, particularly showing the operative state that the crimp terminal is put in practical use.
Figure 11:
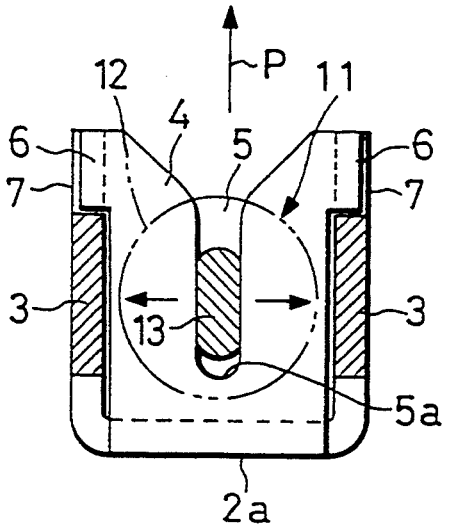
FIG. 11 is a cross-sectional view of the conventional cramp terminal taken along line Z—Z in FIG. 10.
Figure 12:
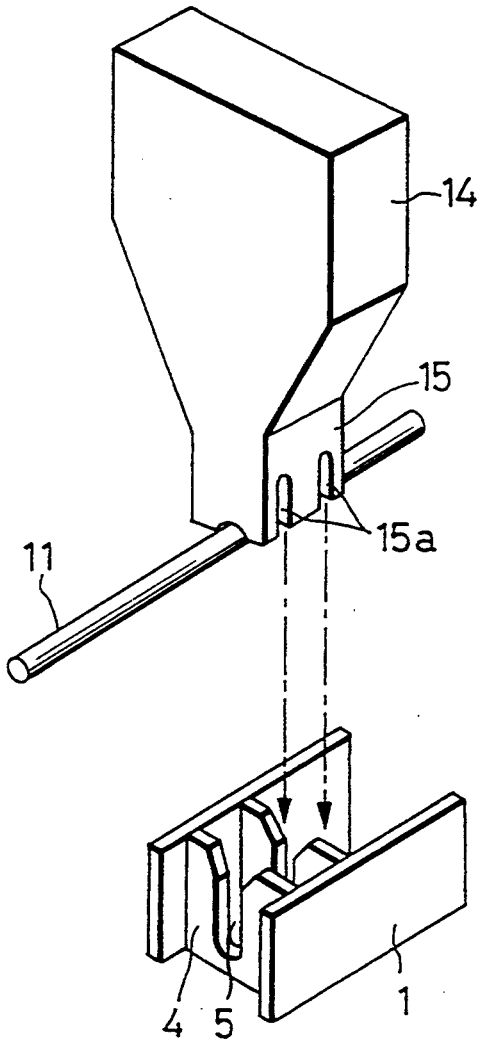
FIG. 12 is a perspective view of an assembly for press-fitting an electrical insulative cable to a terminal casing of the conventional crimp terminal by actuating a conventional press-fitting jig.

Referring to FIG. 1, similar to the conventional crimp terminal described above with reference to FIG. 10 to FIG. 12, the crimp terminal 100 is substantially composed of a terminal casing 101 formed by punching and upwardly bending a sheet of electrical conductive metallic material and a crimping member 120 adapted to be fitted to the terminal casing 101 so as to allow an electrical insulative cable 11 (see FIG. 3) to be press-fitted to two crimping blades 103.

The terminal case 101 includes a sleeve-shaped electrical connecting portion 102 on the fore half side into which an opponent post type terminal (not shown) is fitted, while it includes a pair of cramping blades 103 on the rear half side to which the electrical insulative cable 11 is to be connected.

Each crimping blade 103 is formed by upwardly bending a part of the base plate of the terminal casing 101 while the opposite side extensions of the crimping blade 103 each extending outside of a main body of the cramping blade 103 are received in cutout portions 105 formed at the upper end parts of the opposite side plates 104 of the terminal case 101 so as allow the crimping blade 103 to stand upright from the bottom wall of the terminal casing 101. As is best seen in FIG. 1, the crimping blades 103 are arranged in the terminal casing 101 in the spaced relationship as seen in the longitudinal direction of the cramping terminal 100. A U-shaped slot 106 (see FIG. 4 to FIG. 7), of which upper end part is widened in the transverse direction while orienting in the upward direction, is formed on each crimping blade 103. The electrical insulative cable 11 is press-fitted into the slots 106 of the cramping blades 103 from above so as to make electrical connection between the electrical insulative cable 11 and the cramp terminal 100 as will be described later.

Four vertical extending engagement holes 107 are formed through the opposite side plates 104 of the terminal casing 101 so that four engagement protuberances 123 of the crimping member 120 are fitted into the engagement holes 107 so as to allow the cramping member 120 to be firmly engaged with the terminal casing 101 via the fitting of the engagement protuberances 123 into the engagement holes 107. Two hook-shaped holding pawls 108 each serving as a holding member are formed at the upper ends of both the side plates 104 at the intermediate position between the two cramping blades 103 while they are bent downward of the upper edges of the opposite side plates 104. The rear ends of the opposite side plates 104 are bent in the form of cable retaining pieces 109 to be bent inside of the terminal casing 103 to firmly holding the electrical insulative cable 11 with the retaining pieces 109.

On the other hand, the crimping member 120 is made of a sheet of rectangular metallic material of which opposite ends are downwardly bent to form foot pieces 122 at four corners of the metallic sheet. In practical use, the crimping member 120 is fitted to the terminal casing 101 from above in such a manner as to cover the crimping blades 103 with the crimping member 120. When the crimping member 120 is fitted to the terminal casing 101, the lower surface of a plate portion 121 of the crimping member 120 is brought in close contact with the electrical insulative cable 11 over a large area so as to squeeze the electrical insulative cable 11 against the crimping blades 103 until a cable conductor 13 of the electrical conductive cable 11 is press-fitted into the slots 106 of the crimping blades 103. To this end, four cutout portions 124 are formed in the crimping member 120 at the positions corresponding to the cramping blades 103 so that the cramping blades 103 are inserted through the cutout portions 124 in order to prevent the press-fitting of the electrical insulative cable 11 into the slots 106 from being obstructed by the plate portion 121 of the crimping member 120. To assure that the crimping member 120 is reliably held by the terminal case 101 after the former is fitted to the latter, four engagement protuberances 123 adapted to be slidably engaged with the engagement holes 107 are caused to extend outside of the lower ends of the foot pieces 122. Since each engagement hole 107 is formed through the side plate 104 of the terminal casing 101 in the form of a vertically extending rectangular elongated hole, the engagement projections 123 can slightly be displaced in the engagement holes 107 in the upward/downward direction.

With the crimp terminal 100 constructed in the above-described manner, the engagement protuberances 123 are located at the positions corresponding to the upper ends of the engagement holes 107 immediately after the crimping member 120 is fitted to the terminal casing 101, as shown in FIG. 2. At this time, the cramping member 120 is provisionally retained on the opposite side plates 104 with the aid of the holding pawls 108. Subsequently, as the crimping member 120 is displaced from the foregoing positions in the downward direction, the electrical insulative cable 11 is press-fitted into the slots 106 until it is firmly held in the slots 106. When it is assumed that a height of each foot member 122 is represented by $l_1$ and a length of each engagement hole 107 is represented by $l_2$, an inequality of $l_1 \leqq l_2$ is established therebetween (see FIG. 5).

A series of steps for connecting the electrical insulative cable 11 to the crimp terminal 100 will be described below with reference to FIG. 3 to FIG. 7.

Connection of the electrical insulative cable 11 to the terminal casing 101 is achieved in such a manner that a fore end of the electrical insulative cable 101 is placed on the bottom of the terminal casing 11 as shown in FIG. 3, such that it is located above the slots 106 (see FIG. 4). Subsequently, the crimping member 120 located above the terminal casing 101 at a predetermined position is squeezed in the downward direction by actuating the press-fitting jig 150, and thereafter, the cable retaining pieces 109 are bent around the electrical conductive cable 11, causing the latter to be firmly retained by the cable retaining pieces 109. It should be noted that FIG. 3 is illustrated such that the cable cramping pieces 109 are preliminarily bent before the electrical insulative cable 11 is firmly retained by the cable retaining pieces 109.

In more detail, as shown in FIG. 4, the crimping member 120 is placed on the holding pawls 108 on the side plates 104 of the terminal casing 101, and at this time, as shown in FIG. 5, the engagement protuberances 123 are brought in engagement with the engagement holes 107 at the positions corresponding to the upper ends of the engagement holes 107, whereby the crimping member 120 is provisionally held on the opposite side plates 104. While the foregoing positional state is maintained, the lower surface of the cramping member 120 comes in contact with the electrical insulative cable 11 over a relatively large area.

Next, as the plate portion 121 of the crimping member 120 is thrusted in the downward direction by actuating a press-fitting jig 150 having a simple structure, e.g., as shown in FIG. 3, the cramping blades 103 are inserted through the cutout portions 124 while expanding the holding pawls 108 in the outward direction until they pass past the holding pawls 108 as shown in FIG. 6. Thus, the engagement protuberances 123 are slidably displaced in the engagement holes 107 in the downward direction to reach the lower positions as shown in FIG. 7. As the press-fitting jig 150 is actuated further in the downward direction, the electrical insulative cable 11 is squeezed against the crimping blades 103 by the plate portion 121 of the crimping member 121, causing the electrical insulative cable 11 to be gradually press-fitted or thrusted into the slots 106. Finally, the electrical insulative cable 11 is held immovable relative to the cramping blades 103. As a result, a sheath 12 of the electrical insulative cable 11 is torn off of the cable conductor 13 by the crimping blades 103 so that the cable conductor 13 of the electrical insulative cable 11 is electrically connected to the crimping blades 103, whereby the crimp terminal 100 is electrically connected to the electrical conductive cable 11 via the crimping blades 103 and the cable conductor 13.

Referring to FIG. 6 again, while the electrical insulative cable 11 is press-fitted or thrusted into the slots 106, the upper surface of the plate portion 121 of the cramping member 120 comes in contact with the lower ends of the holding pawls 108. Thus, the cramping member 120 can not be displaced in the upward direction any more. In other words, there does not arise a malfunction that the electrical insulative cable 11 is disconnected from the terminal casing 101 in the upward direction.

Figure 8:
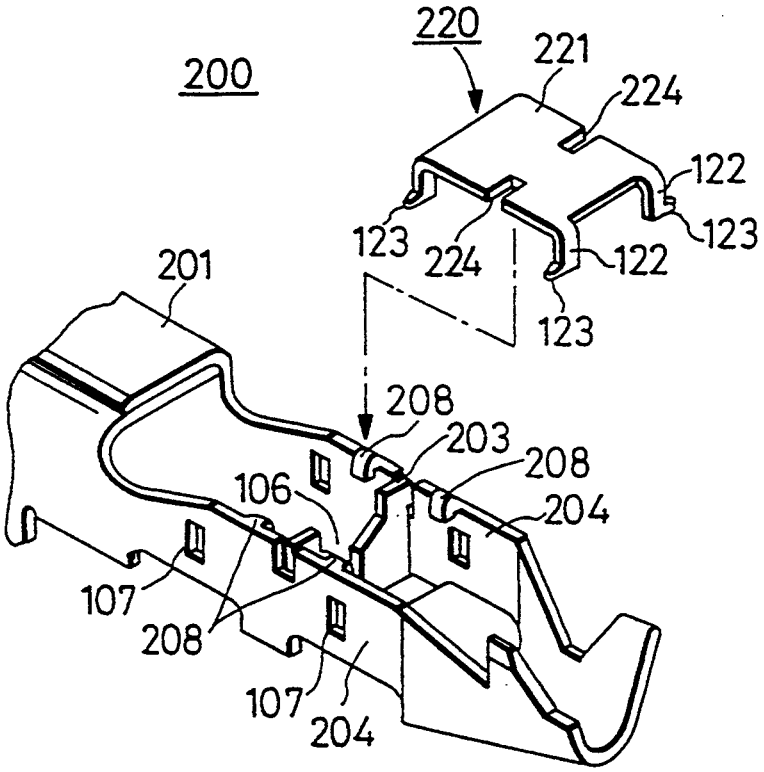
FIG. 8 is a fragmentary perspective view of a crimp terminal constructed according to a second embodiment of the present invention, particularly showing essential components constituting the crimp terminal in the disassembled state.

Next, a crimp terminal constructed according to a second embodiment of the present invention will be described below with reference to FIG. 8. FIG. 8 shows by way of perspective view essential components constituting the crimp terminal in the disassembled state.

The crimp terminal 200 constructed according to the second embodiment of the present invention is different from the crimp terminal 100 constructed according the first embodiment of the same in respect of the number of cramping blades, the number of hook-shaped holding pawls each serving as a holding member and the arrangement and relationship among these components. In view of the foregoing fact, the same components as those in the preceding embodiment are represented by same reference numerals with the exception of the cramping blades, the hook-shaped holding pawls and a cramping member, and repeated description on these components is omitted for the purpose of simplification.

Specifically, the crimp terminal 200 is substantially composed of a single cramping blade 203 formed by upwardly bending a sheet of electrical conductive metallic material and two pairs of holding pawls 208 formed on the opposite side plates 204 at the positions in the vicinity of the cramping blade 203. A cramping member 220 is designed in the substantially same configuration as that in the preceding embodiment, and a pair of cutout portions 224 are formed in a plate portion 221 of the cramping member 220. Four foot pieces 122, four engagement protuberances 123 extending outside of the lower ends of the four foot pieces 122, a U-shaped slot 106 formed through the crimping blade 203, and four engagement holes 107 formed through a terminal casing 201 are designed in the same manner as those in the preceding embodiment.

With the crimp terminal 200 constructed in the above-described manner, as the plate portion 221 of the crimp member 220 is thrusted or press-fitted against the crimping blade 203 in the downward direction by actuating a press-fitting jig (not shown), the engagement protuberances 123 are slidably displaced in the engagement holes 107 on the opposite side plates 204 in the downward direction to reach the lower positions in the engagement holes 107 where an electrical insulative cable (not shown) is thrusted and press-fitted into the U-shaped slot 106 of the crimping blade 203 by the plate portion 221 of the crimping member 220. At this time, the upper surface of the plate portion 221 of the cramping member 220 comes in contact with the lower ends of the holding pawls 208 so that the crimping member 220 is retained in the terminal casing 201 by the holding pawls 208.

Figure 9:
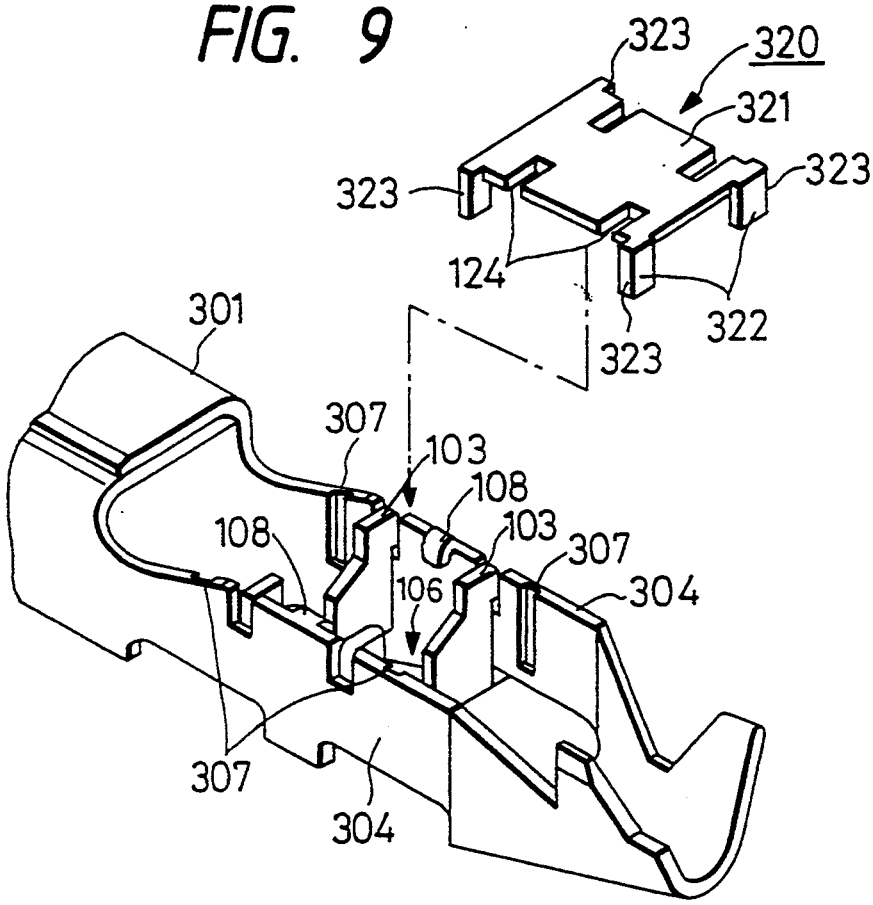
FIG. 9 is a fragmentary perspective view of crimp terminal constructed according to a third embodiment of the present invention, particularly showing essential components constituting the crimp terminal in the disassembled state.

Next, a crimp terminal 300 constructed according to a third embodiment of the present invention will be described below with reference to FIG. 9.

In this embodiment, two pairs of vertically extending guide grooves 307 are formed along the inner side wall surfaces of the opposite side plates 304 of a terminal casing 301 at the positions in the vicinity of crimping blades 103. Each guide groove 307 serves as a guide member for allowing a protuberance (323) of a cramp member 320 to be described later to be slidably displaced along the guide groove 307. Other components formed on the terminal casing 301 are constructed in the same manner as those in the first embodiment of the present invention and represented by same reference numerals, and repeated description on these components is omitted for the purpose of simplification.

On the other hand, a crimping member 320 includes a plate portion 321 and four foot pieces 322. As the foot pieces 322 are inserted into the guide grooves 307 after the crimping member 320 is fitted to the terminal casing 301, they are expanded in the direction at a right angle relative to the longitudinal direction of the terminal casing 301, and the outermost ends of the foot pieces 322 serve as protuberance edges 323.

With the crimp terminal 300 constructed in the above-described manner, when the crimping member 320 is fitted to the terminal casing 301, the protuberance edges 323 of the crimping member 320 are inserted into the guide grooves 307 until the plate portion 321 of the crimping member 320 is placed on two holding pawls 108, whereby the crimping member 320 is provisionally held on the opposite side plates 304. In this embodiment, when the terminal casing 301 and the cramping member 320 are turned upside down, the crimping member 320 can easily be disconnected from the terminal casing 301.

As the plate portion 321 of the cramping member 320 is thrusted against the cramping blades 103 in the downward direction by actuating a press-fitting jig (not shown), the crimping blades 103 are inserted through cutout portions 124 of the plate portion 321 in the same manner as the preceding embodiments, and the protuberance edges 323 are slidably displaced along the guide grooves 307 in the downward direction. When the lower surface of the plate portion 321 of the crimping member 320 is located beneath the lower ends of holding pawls 108, the crimping member 320 is firmly held by the holding pawls 108. In the meanwhile, as an electrical insulative cable (not shown) is squeezed against the cramping blades 103 by the lower surface of the plate portion 321, it is press-fitted into the U-shaped slots 106 of the cramping blades 103 so that it is firmly held in the terminal casing 301 by the cramping blades 103.

A plurality of cramp terminals each constructed according to each of the aforementioned embodiments are received in the corresponding receiving chambers in a housing to serve as connectors.

As is apparent from the above description, according to the present invention, the crimp terminal is constructed such that the crimping member is slidably thrusted against the crimping blades in the downward direction in the terminal casing to reach the position where the lower surface of the crimping member comes in contact with an electrical insulative cable, in area, so as to allow the latter to be subsequently press-fitted into the U-shaped slots of the crimping blades by actuating a press-fitting jig having a simple structure. Although the press-fitting jig is located with slight positional deviation relative to the crimp terminal, it suffices that a part of the flat upper surface of the crimping member is squeezed against the crimping blades in the downward direction by actuating the press-fitting jig. Thus, there does not arise a malfunction that the crimping blades are damaged or broken by the press-fitting jig due to collision of the latter against the crimping blades.

Once an electrical insulative cable is press-fitted into the slots of the crimping blades, since the upper ends of the slots are closed with the crimping member while the latter is retained by the holding pawls, there does not arise a malfunction that the electrical insulative cable is disconnected from the slots of the crimping blades. In addition, since the crimping member serves as a kind of cover for the crimped parts on the electrical insulative cable, there does not arise another malfunction that dust or similar foreign material invades in the connected part between the electrical insulative cable and the crimp terminal.

What is claimed is:

1. A terminal for retaining a cable including at least one conductor and an insulating sheath surrounding the conductor, comprising:
   - a terminal body including:
     - at least one crimping blade formed by bending a portion of the terminal body, said crimping blade having a slot formed therein to allow the cable to be press-fitted therein such that the sheath is at least partially torn causing said at least one conductor to contact said crimping blade, said crimping blade being connected to side plates of the terminal body;
     - a guide formed on said side plates of the terminal body;
     - a holding member provided on each of said side plates; and
     - a crimping member for press-fitting the cable into said slot and retaining the cable therein, said crimping member being guided by said guide and being secured to said terminal body by said holding member.

2. A terminal as claimed in claim 1, where in said holding member includes holding pawls bent inwardly to confront each other.

3. A terminal as claimed in claim 1, wherein said crimping member is a rectangular-plate, said crimping member including at least one engagement projection slidably received in said guide and a slit provided in a side edge thereof in which a portion of said crimping blade is received.

4. A terminal as claimed in claim 3, wherein said guide includes an engagement hole.

5. A terminal as claimed in claim 3, wherein said guide includes an engagement groove.

* * * * *